US005850842A

United States Patent [19]

Sweeney et al.

[11] Patent Number: 5,850,842

[45] Date of Patent: Dec. 22, 1998

[54] CAM LATCHING MECHANISM FOR A PARTS WASHER

[75] Inventors: Thomas Michael Sweeney, Baltimore; Randal Monroe Brown, Hanover, both of Md.; Bryan Engle Patterson, Delta, Pa.; Kenneth John Breece, Street; John Paul Brubaker, Jr., Catonsville, both of Md.

[73] Assignee: Better Engineering Mfg., Inc., Baltimore, Md.

[21] Appl. No.: 878,138

[22] Filed: Jun. 19, 1997

Related U.S. Application Data

[63] Continuation-in-part of Ser. No. 855,608, May 13, 1997, abandoned.

[51] Int. Cl.[6] ..... B08B 3/04

[52] U.S. Cl. ..... 134/140; 134/158

[58] Field of Search ..... 134/135, 140, 134/157, 159, 160, 120, 83, 200; 118/418; 68/139, 140; 210/380.3

[56] References Cited

U.S. PATENT DOCUMENTS

| | | | |
|---|---|---|---|
| 760,118 | 5/1904 | Herbine et al. | 68/139 |
| 924,864 | 6/1909 | Wilcox et al. . | |
| 981,833 | 1/1911 | Baxter . | |
| 1,006,245 | 10/1911 | Lutes . | |
| 1,008,743 | 11/1911 | Smith . | |
| 1,067,887 | 7/1913 | Taylor et al. . | |
| 1,141,235 | 6/1915 | De Hay | 68/139 |
| 1,209,983 | 12/1916 | Lyche | 68/139 |
| 1,544,325 | 6/1925 | Lantz | 68/139 |
| 1,718,191 | 6/1929 | Couch | 68/140 |
| 2,953,012 | 9/1960 | Davis | 68/139 |
| 3,280,603 | 10/1966 | Schwamm | 68/139 |
| 3,480,315 | 11/1969 | Wolverton | 68/139 |

OTHER PUBLICATIONS

"*Clam: Aqueous Parts Cleaning Systems*", Product Brochure, Clam Products Division, G.M.F. Industries, Inc., date unknown.

"*Cyclojet 3: Orbital Jet Washer*", Product Brochure, Better Engineering Mfg., Inc., 1995.

"*Jet Washing: The Cyber–Jets*", Product Brochure, Better Engineering Mfg., Inc., Aug. 1996.

"*Jet Washing: Impulse 2*", Product Brochure, Better Engineering Mfg., Inc. 1995.

"*Jet Washing: The Purifiers*", Product Brochure, Better Engineering Mfg., Inc., date unknown.

"*Jet Washing: PCS Systems*", Product Brochure, Better Engineering Mfg., Inc., 1995.

*Primary Examiner*—Amy Vanatta

*Attorney, Agent, or Firm*—Sterne, Kessler, Goldstein & Fox P.L.L.C.

[57] ABSTRACT

A tumbling-type parts washer includes an apparatus for automatically securing a basket in a rotor assembly of the parts washer and for securing a lid onto the basket during parts cleaning. The apparatus includes a cam plate mounted to a wall of the housing of the parts washer and one or more torsion bar assemblies mounted for rotation with the rotor assembly. Each torsion bar assembly is operable between an open position that permits removal of the basket from the rotor assembly and a closed position that prevents removal of the basket from the rotor assembly. The cam plate defines a substantially circular cam surface with an open portion. The torsion bar assembly includes a torsion bar pivotally mounted on the rotor assembly, one or more basket retainers mounted on the torsion bar, and a cam follower mounted on a crank arm portion of the torsion bar. The cam follower is configured to align with the open portion of the cam surface when the rotor assembly is in the loading/unloading position to permit the torsion bar to be pivoted between the open position and the closed position for removal of the basket, and to engage the cam surface of the cam plate during at least a portion of rotation of the rotor assembly from the loading/unloading position to secure the basket in the rotor assembly.

(List continued on next page.)

24 Claims, 13 Drawing Sheets

U.S. PATENT DOCUMENTS

| | | | |
|---|---|---|---|
| 3,553,982 | 1/1971 | Berry et al. | 68/139 |
| 3,780,545 | 12/1973 | Henderson et al. | 68/139 |
| 5,042,856 | 8/1991 | Goodman | 292/259 |
| 5,056,456 | 10/1991 | Kobayashi | 118/418 |
| 5,118,000 | 6/1992 | Howell et al. | 220/315 |
| 5,535,766 | 7/1996 | Edwards | 134/60 |

CAM LATCHING MECHANISM FOR A PARTS WASHER

RELATED APPLICATION

This application is a continuation-in-part of U.S. application Ser. No. 08/855,608, filed on May 13, 1997, entitled "Cam Retaining Latch for a Parts Washer," now abandoned.

BACKGROUND OF THE INVENTION

1. Field of the Invention

The present invention relates to precision parts washers and, more particularly, to a mechanism for automatically securing a parts-holding basket in a rotating or tumbling-type parts washer.

2. Related Art

Precision parts washers are used by many industries to clean various types of parts. The automotive industry uses precision parts washers to clean contaminants such as grease and dirt from engines, transmission parts, starters, clutches, and CV joints, for example. Similarly, the machine parts manufacturing and metal finishing industries use precision parts washers to clean post-machine finished parts of contaminants such as coolant, oil, and metal chips, for example.

It is common for precision parts washers to clean away contaminants using the mechanical action of a tumbling or rotating motion in combination with the chemical action of a cleaning solution. Parts are placed in perforated baskets or holding fixtures and immersed in or sprayed with the cleaning solution while the baskets undergo a tumbling or rotating motion. In these rotating-type parts washers, the baskets must be held closed and in place when tilted or inverted during the washing process. Otherwise, the basket may separate from the tumbling mechanism and/or the parts may spill from the basket.

Often, baskets are held in place using screw down clamps, cross-center spring retaining clamps (e.g., ski boot fasteners), or crank handle double-screw-acting hold down blocks. All of these techniques share a common characteristic: the operator must manually secure the baskets each time parts are loaded or unloaded. If an operator fails to secure them, the parts tumble out of the baskets into the cleaning solution, as well as into the parts washer internals. The baskets are also loosed and free to jam the parts washer. This commonly results in damage to baskets, damage to drive components, and damage to the parts being washed.

In the highly competitive precision cleaning machinery industry, keeping costs down is of paramount importance. Customers want reliable precision parts washing systems that have minimum down time. What is needed, therefore, is a mechanism for automatically securing baskets during the rotary or tumbling cleaning process.

SUMMARY OF THE INVENTION

Briefly stated, the present invention is directed to a rotating or tumbling-type parts washer including a mechanism for automatically holding one or more baskets inside a rotor assembly of the parts washer without requiring operator intervention so that the rotor assembly may be rotated and the parts tumbled without the parts spilling from the baskets.

The parts washer of the present invention includes a housing, a rotor assembly, at least one basket, and a mechanism for automatically securing the basket in the rotor assembly. During washer operation, the rotor assembly rotates about an axis, wherein 0° of rotation represents the rotor assembly in an upright position. After an operator has loaded the parts washer and starts the cycle, the rotor assembly rotates so that the baskets are immersed in a cleaning solution. Alternatively, the rotor assembly rotates while the parts are sprayed with cleaning solution. The parts washer also permits the parts to be rinsed by immersion or spraying and to be dried using forced air and/or heat.

The basket for holding parts to be cleaned may be fixed in the rotor assembly or may be removable. Similarly, a basket lid may or may not be included. If included, the basket lid may or may not be completely removable. In a preferred embodiment, the lid is completely removable from the basket and from the parts washer. In an alternative embodiment, the lid is mounted to the basket using a hinging mechanism, for example.

In a first embodiment, the parts washer of the invention is implemented in a top-loading, tumbling-type parts washer that has a single basket and removable lid. For example, a parts washer suitable for implementation of the present invention is a Cyclojet Jet Washer, available from Better Engineering Mfg., Inc., Baltimore, Md. The securing mechanism of the invention automatically secures a lid to the basket and the basket in the rotor assembly when the rotor assembly is rotated from the upright position.

The securing mechanism includes a cam plate, a torsion bar, a crank arm, a basket retainer, a cam follower, a helper spring and a cross-center crank. The cam plate is mounted on the inner wall of the housing adjacent to the rotor assembly. All remaining components of the securing mechanism are mounted on the rotor assembly.

The torsion bar is mounted to the rotor assembly and is configured to pivot on an axis parallel to the axis of rotation of the rotor. The basket retainer is mounted on the torsion bar. The torsion bar pivots between an open position in which the basket retainer stands clear of the basket and basket lid to permit the basket and/or lid to be removed and a closed position in which the basket retainer contacts the basket lid. The crank arm is mounted at an end of the torsion bar, such that the crank arm pivots when the torsion bar pivots. The cam follower is attached to the crank arm.

The cam plate defines a substantially circular cam path with an open portion. The cam plate is mounted to the wall of the housing near the end of the rotor so that the center of the cam path is coincident with the axis of rotation of the rotor. When the torsion bar is in the closed position, the cam follower is positioned into the entrance opening of the cam plate. When the rotor is rotated from vertical, the cam follower enters the closed portion of the cam path and engages the cam surface. Engagement of the cam follower with the cam surface prevents the torsion bar from pivoting. Thus, the basket retainer mounted on the torsion bar will securely hold the lid onto the basket, and the basket into the rotor whenever the rotor is rotated from the upright, loading/unloading position.

During a wash operation, the rotor is rotated many cycles. Upon completion of a wash cycle, the rotor completes a final revolution such that the cam follower is again positioned in the opening of the cam plate (i.e., the cam follower is permitted to disengage from the cam surface). Only in this position can the torsion bar be pivoted by an operator into the open position.

The substantially circular cam surface of the cam plate has a larger radius near the entrance opening. This feature provides a smooth transition during engagement/disengagement of the cam follower with the cam surface at the entrance opening. In addition, when the basket is in an upside down position, the cam surface forces the torsion bar into engagement with the basket such that a compressive load is applied by the torsion bar to the basket to hold it snugly in position. When the basket approaches the upright position, the larger radius of the cam surface decompresses the load that the torsion bar puts on the basket.

In this first embodiment, the parts washer includes a top-mounted door that provides access to the internal wash space of the washer. The door must be opened to gain access to the rotor assembly and must be closed before a wash operation can commence. When a basket is being loaded into the rotor assembly, the torsion bar is pivoted to the open position. In the open position, the basket retainer extends outward from the torsion bar such that it rests near the door. If an attempt is made to close the door without first moving the torsion bar into the closed position, the door will push against the basket retainer, automatically forcing the torsion bar into the closed position. A cross-center crank and spring assembly assures that the torsion bar assembly falls completely into the closed position. Thus, no separate operator action is required to secure the basket and lid into the rotor. The basket and lid will be secured in the rotor simply by virtue of closing the washer door and commencing tumbling.

In a second embodiment, the invention is implemented in a front-loading, rotating parts washer that accepts two baskets at a time. Operation of the invention in this second embodiment is substantially similar to the operation of the first embodiment. However, the rotor assembly in the parts washer of the second embodiment is configured to accept two baskets; each basket being mounted at opposite sides of the rotor so that they are loaded into the rotor 180° of rotation apart from one another. In addition, lids are not necessarily used with the baskets. Instead, in a preferred implementation, the rotor assembly itself may form a lid for each basket as it is slid horizontally into the rotor assembly.

To accommodate two baskets, this embodiment of the invention includes two cam mechanisms; one for each basket. The cam mechanisms are actuated 180° apart from one another so that while one basket is in an unsecured, horizontal position for loading/unloading, the other basket is held securely at the rear of the rotor in an upside down position.

Further features and advantages of the invention, as well as the structure and operation of various embodiments of the invention, are described in detail below with reference to the accompanying figures.

DETAILED DESCRIPTION OF THE PREFERRED EMBODIMENTS

The present invention is directed towards a rotating or tumbling-type parts washer with a cam latching mechanism that automatically secures a basket and its lid in a rotor assembly of the parts washer when the rotor assembly is rotated or tumbled during the cleaning process. The cam latching mechanism of the invention eliminates the need for an operator to manually secure the basket or the basket lid after loading or unloading parts.

I. Example Environment

The automatic cam latching mechanism of the present invention operates in an aqueous-based environment commonly encountered by precision parts cleaning systems. For example, the aqueous-based solution is primarily water, but may also include a metasilicate (alkaline), a sodium/potassium hydroxide (caustic), a synthetic (e.g., glycol-based), or a citrus-based detergent. Other cleaning solutions may be utilized as well.

The environment commonly contains small metal chips and other contaminants loosed during the cleaning process. That is, because an objective of the parts washer is to rid parts of debris and other contaminants, some of these contaminants are released into the cleaning solution during the cleaning process. Therefore, operation of the washer must not be hindered by fouled surfaces or by particles suspended in the cleaning solution and must not be dependent upon an intricate mechanical construction capable of trapping debris.

In addition, parts washers frequently operate at high temperatures. For example, the cleaning solution itself may be heated in order to facilitate cleaning. Additionally, the parts washer may have a heated drying stage. Therefore, the washer must be able to withstand such a high temperature environment. Moreover, since operators often wear gloves to protect their hands, making intricate maneuvers difficult, the washer should be simple to operate.

Parts washers may also be subjected to heavy, loose, or eccentric loads. A heavy load may be, for example, an iron casting that needs to be cleaned of molding compound, flux, or sand after molding. A loose load may be, for example, several thousand small metal rivets, and an eccentric load may be jet engine components. Therefore, the parts washer must be strong enough to handle these loads. Additionally, the parts washer is often subjected to rough handling by operators.

In summary, a parts washer must endure high temperature, high-stress, water-based environments. They must be strong, durable and simple to operate. Thus, a basket retaining or latching mechanism must have these same characteristics. The present invention provides such a basket retaining mechanism.

II. Construction of Parts Washer 100

Figure 1:
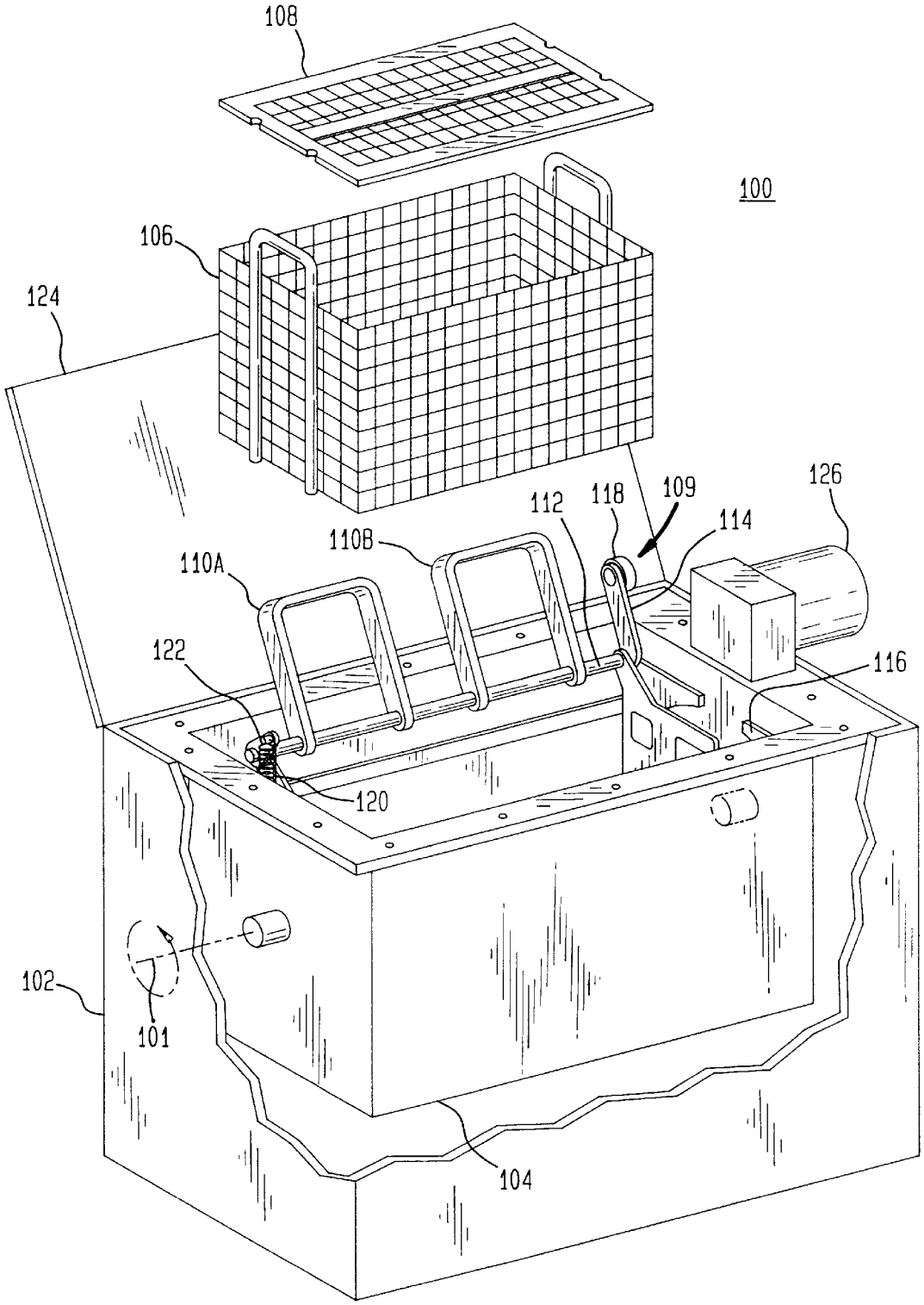
FIG. 1 is an exploded view of a first preferred embodiment of the invention implemented in a top-loading parts washer.

FIG. 1 illustrates a first preferred embodiment of the present invention in a parts washer 100. Parts washer 100 is a tumbling-type parts wash with a cam latching mechanism that automatically secures a basket and its lid inside a rotor assembly of the parts washer when the rotor assembly is rotated or tumbled during the cleaning process. Parts washer 100 operates in an aqueous-based, high temperature, chip-filled environment commonly encountered by precision parts cleaning systems. Parts washer 100 is also capable of handling loose, eccentric, and heavy loads.

Parts washer 100 includes a housing 102, a rotor assembly 104, a basket 106 for holding parts to be cleaned, a lid 108 for covering basket 106, a door 124, and a cam latching mechanism 109 for automatically securing lid 108 to basket 106 and basket 106 in rotor assembly 104.

Parts washer 100 may be portable (i e., mounted on casters or wheels). However, housing 102 is stationary (with respect to rotor assembly 104) during rotating or tumbling operations.

Rotor assembly 104 is configured to receive basket 106 for rotation. In a preferred embodiment, rotor assembly 104 is configured to receive a single basket 104. In an alternate embodiment, rotor assembly 104 may be configured to receive a plurality of baskets 104. In addition, while the preferred embodiments of the invention are described with reference to a parts washer for receiving one or more baskets, other work pieces may be substituted for the baskets.

According to the present invention, an operator loads the parts to be washed in basket 106, places lid 108 onto basket 106, places basket 106 and lid 108 inside rotor assembly 104, closes door 124, and starts parts washer 100.

In a preferred embodiment, basket 106 is removable from rotor assembly 104. In an alternate embodiment, a parts receptacle (not shown) is fixedly mounted in rotor assembly 104. Similarly, in a preferred embodiment, lid 108 is completely removable from basket 106 and parts washer 100. Alternatively, lid 108 may be mounted to basket 106 with a hinge, for example. During washer operation, a drive mechanism 126 rotates rotor assembly 104 about axis 101. Drive mechanism 126 includes a conventional electric motor and chain drive mechanism.

Example operation of parts washer 100 is as follows. After an operator has loaded parts washer 100 and started the cycle, rotor assembly 104 rotates so that basket 106 is immersed in a cleaning solution. Alternatively, rotor assembly 104 rotates while the parts are sprayed with cleaning solution. In the tumble dry stage, rotor assembly 104 may tumble so that the parts are air or heat dried. In a rinse stage, rotor assembly 104 tumbles so that basket 106 is immersed in fresh water. Alternatively, in a rinse stage, rotor assembly 104 tumbles while the parts are sprayed with rinse water. In any event, basket 106 and lid 108 are secured in rotor assembly 104 using cam latching mechanism 109 whenever rotor assembly 104 is rotated from an upright position.

Cam latching mechanism 109 comprises a plurality of basket retainers 110A and 110B, a torsion bar 112, a crank arm 114, a cam plate 116, and a cam follower 118. In an alternate embodiment, cam latching mechanism 109 also includes a helper spring 120 and a cross-center crank 122. Operation of cam latching mechanism 109 is described in greater detail below.

In a preferred embodiment, each of basket retainers 110A and 110B is a U-shaped member. Alternatively, retainers 110A and 110B may be replaced with a single U-shaped member, a solid member, or any other basket retaining mechanism without departing from the spirit and scope of the present invention, as will be apparent to persons of ordinary skill in the art.

Torsion bar 112 may be any member sufficiently rigid to perform the functions of torsion bar 112 described below. In a preferred embodiment, torsion bar 112 is a rigid steel rod. Similarly, crank arm 114 may be any member sufficiently rigid to perform the functions of crank arm 114 described below. In a preferred embodiment, crank arm 114 is made from stainless steel. Cam plate 116 may be any member capable of performing the cam guiding function described below. Cam plate 116 defines a radial cam surface, and is preferably manufactured from stainless steel.

Cam plate 116 defines a substantially circular cam path with an opening near the top. Cam plate 116 is mounted to the wall of housing 102 as illustrated so that the center of the cam path is coincident with the axis 101 of rotation of the rotor. Thus, because housing 102 is stationary (with respect to rotor assembly 104) during rotating or tumbling operations, cam plate 116 is also stationary during rotating or tumbling operations.

Cam follower 118, in a preferred embodiment, is a conventional roller follower. Alternatively, cam follower 118 may be replaced by a flat follower. Cam follower 118 is mounted on a distal end of crank arm 114.

Helper spring 120 is a conventional extension spring. Cross-center crank 122 is made from stainless steel.

Torsion bar 112 is pivotally mounted on rotor assembly 104 such that torsion bar 112 is operable between a open position and a closed position. Basket retainers 110A and 110B, a proximal end of crank arm 114, and cross-center crank 122 are mounted on torsion bar 112 such that when torsion bar 112 operates between the open position and the closed position, basket retainers 110A and 110B, crank arm 114, cross-center crank 122, and cam follower 118 move between the open position and the closed position as well.

III Operation of Parts Washer 100

FIG. 1 depicts torsion bar 112 in the open position. The open position is the position used for loading and unloading of parts washer 100. To place torsion bar 112 in the open position, the operator rotates basket retainers 110A and 110B towards door 124, out of the operator's way. In so doing, basket retainers 110A and 110B, crank arm 114, cross-center crank 122, and cam follower 118 all move simultaneously to the open position. Accordingly, in the open position, basket retainers 110A and 110B are disengaged from basket 106 and lid 108 allowing removal of basket 106 and lid 108 from rotor assembly 104 and from parts washer 100. Moreover, in the open position, helper spring 120 and cross-center crank 122 cooperate to urge or maintain torsion bar 112 in the open position so that basket retainers 110 do not fall onto the operators hands during loading and unloading of parts washer 100.

Also note that in this open position, the basket retainers 110 rest against door 124. As a result, door 124 cannot be closed without forcing torsion bar 112 into the closed position. The beneficial consequences of this interaction are described in detail below.

Figure 2:
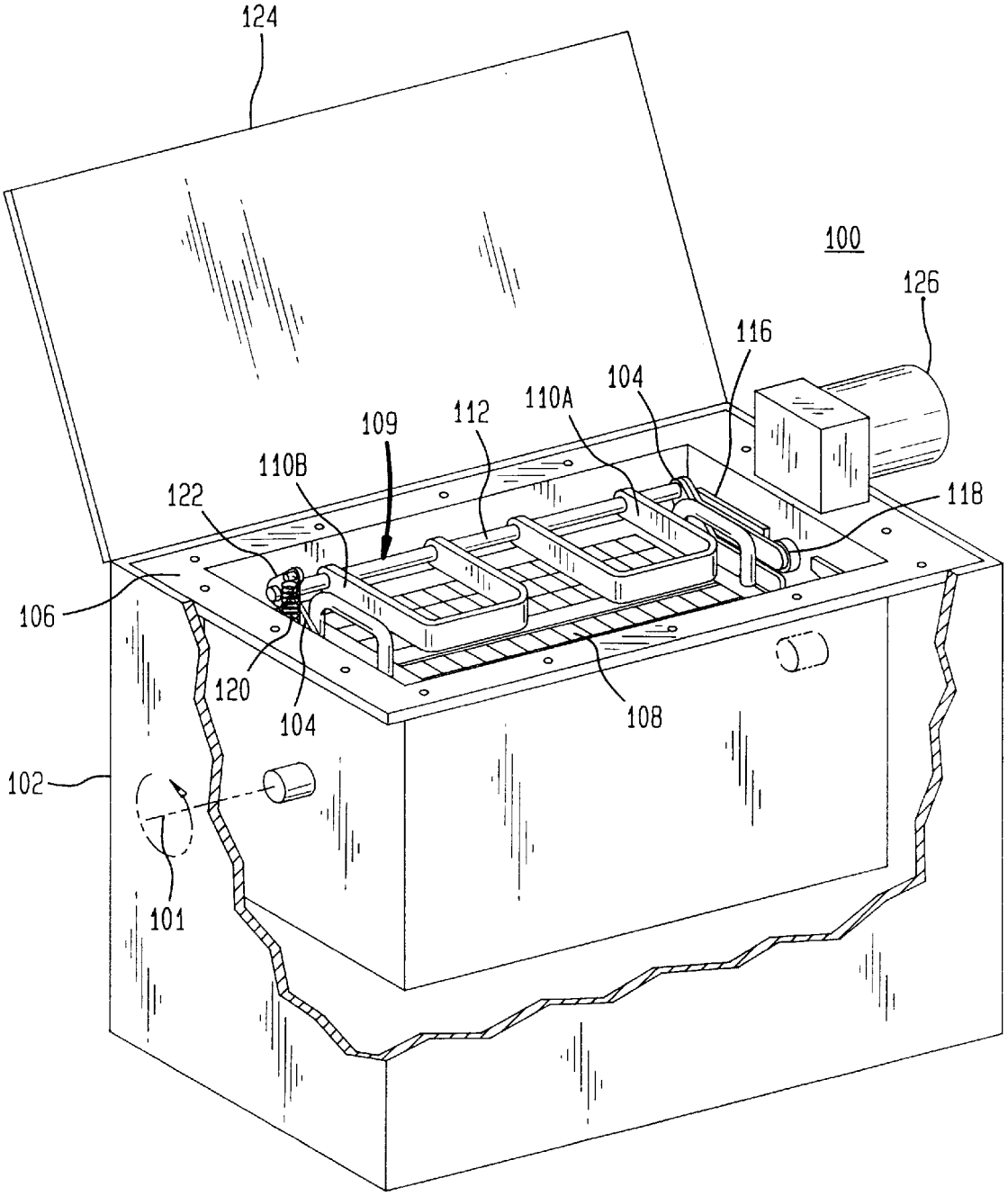
FIG. 2 illustrates the parts washer of FIG. 1 with a basket in a rotor assembly and with a cam latching mechanism in a closed position.

FIG. 2 depicts torsion bar 112 in the closed position. After basket 106 is loaded into rotor assembly 104, the operator may manually move basket retainers 110A and 110B into the closed position. In the closed position, basket retainers 110A and 110B engage basket 106 and lid 108. Alternatively, the operator can close parts washer door 124 without manually moving basket retainer 110 into the closed position. In this instance, basket retainers 110A and 110B are automatically forced into the closed position by door 124. Note that parts washer door 124 engages both cam follower 118 and basket retainers 110 and pushes them toward the closed position. When cross-center crank 122 crosses the center of the axis of rotation of torsion bar 112, helper spring 120 exerts a positive force on the pivoting torsion bar 112 sufficient to pull cam retaining mechanism 109 into the closed position. Note the difference between the position of helper spring 120 and cross-center crank 122 when cam retaining mechanism 109 is in the closed position as depicted in FIG. 2 and the position of helper spring 120 and cross-center crank 122 when cam retaining mechanism 109 is in the open position as depicted in FIG. 1. Also note the difference in the position of cam follower 118 with respect to cam plate 116 when the cam retaining mechanism 109 is in the closed position as depicted in FIG. 2 and when cam retaining mechanism 109 is in the open position as depicted in FIG. 1.

Figure 3:
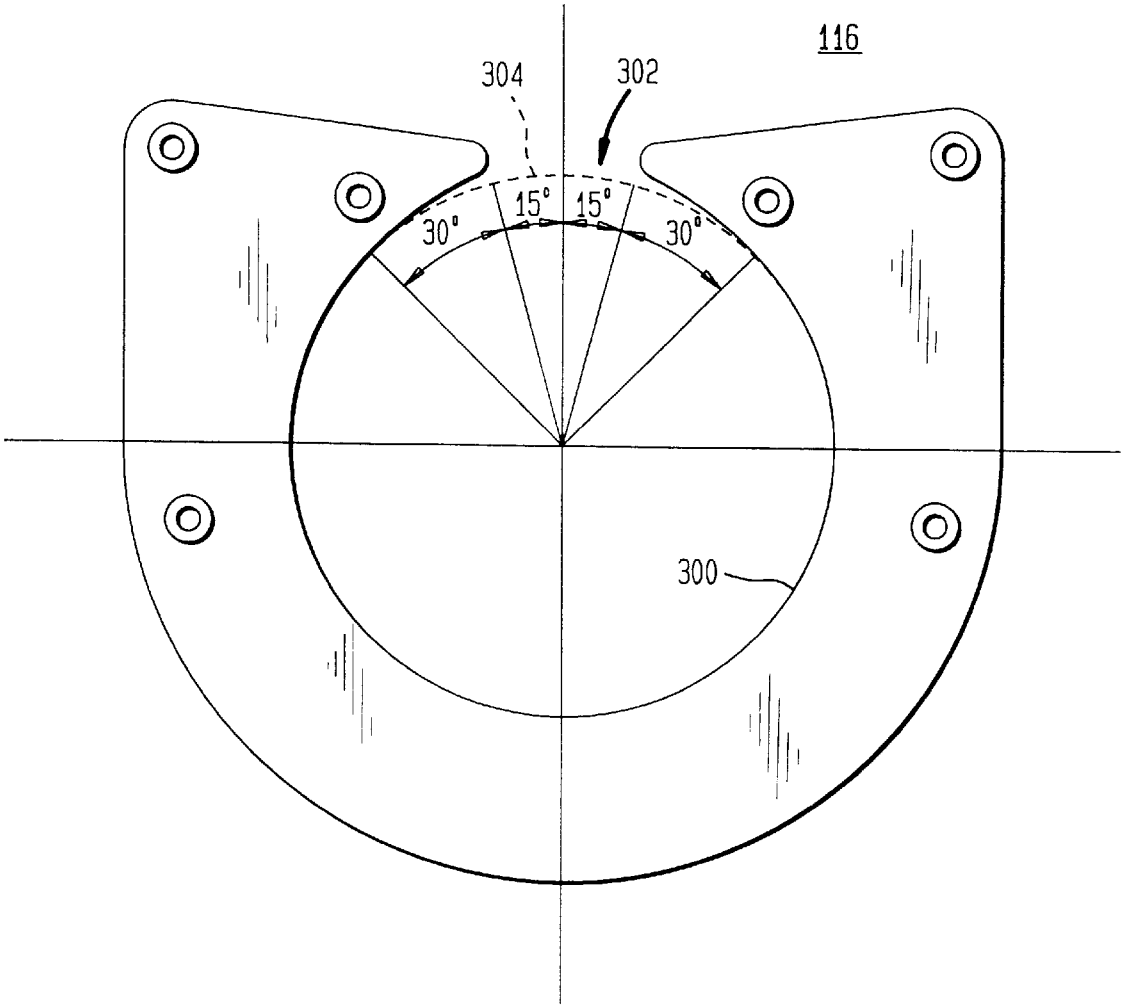
FIG. 3 illustrates a cam plate of the first preferred embodiment of the invention.

Referring to FIG. 3, which illustrates a cam plate 116 suitable for implementation of this first preferred embodiment of the present invention, cam plate 116 defines a substantially circular cam surface 300 that has an entrance opening 302. Entrance opening 302 encompasses approximately a 30° arc of the substantially circular cam path.

Note that cam plate 116 does not define a perfectly circular cam path. Rather, cam surface 300 of cam plate 116 is relieved (i.e, has larger radius) near of entrance opening 302 to provide a smooth engagement/disengagement of cam follower 118 with cam surface 300 near entrance opening 302. Dashed line 304 illustrates the constant radius arc that cam surface 300 would follow if cam surface 300 was not "relieved" near opening 302. Note that cam surface 300 is relieved for an arc of approximately 30 degrees on each side of the 30 degree arc that makes up opening 300.

Figure 4:
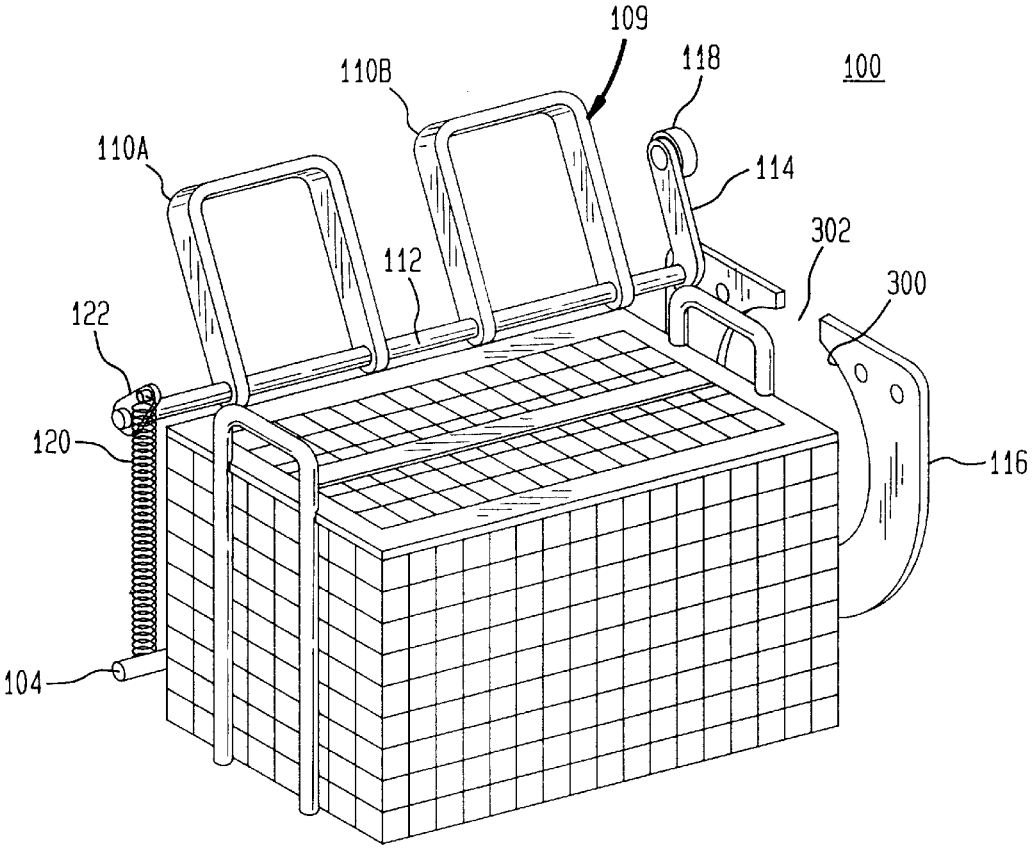
FIG. 4 illustrates a basket with the cam latching mechanism in an open position.

FIG. 4 illustrates basket 106 in rotor assembly 104 with cam latching mechanism 109 in the open position. Note that cam retaining mechanism 109 is positioned such that cam follower 118 has moved clear of cam plate opening 302.

Conversely, note with respect to FIG. 2 that crank arm 114 has dropped into entrance opening 302 of cam plate 116 such that cam follower 118 aligns with entrance opening 302 when cam retaining mechanism 109 is in the closed position. Cam retaining mechanism 109 moves to the closed position regardless of whether the operator manually moves cam retaining mechanism 109 into closed position by using basket retainers 110A and 110B or whether the operator simply closes parts washer door 116. In either case, basket retainers 110A and 110B engage basket 106 and lid 108.

An advantage of the invention is that engagement of basket retainers 110 with basket lid 108 is automatic. This is because parts washer 100 has an interlock to prevent starting a washing cycle with parts washer door 124 open. Thus, the operator must close parts washer door 124 prior to starting parts washer 100.

After the operator has placed the parts in basket 106, placed lid 108 onto basket 106, placed basket 106 and lid 108 into rotor assembly 104, and closed parts washer door 124, the operator may start cleaning operations of parts washer 100. For example, after the operator has loaded parts washer 100 and started the wash cycle, rotor assembly 104 tumbles so that basket 106 is immersed in or sprayed with cleaning solution. Rotor assembly 104 may tumble to dry the parts. In a rinse stage, rotor assembly 104 tumbles so that the basket 106 is immersed in or sprayed with fresh water or other suitable rinsing solution.

Figure 5:
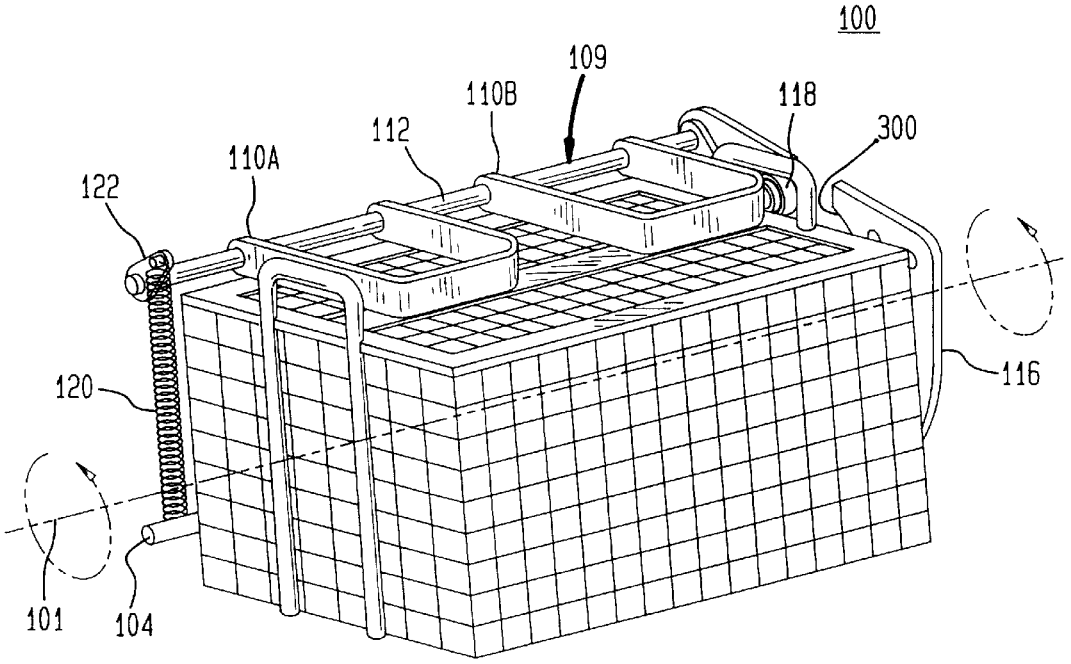
FIG. 5 illustrates the basket with the cam latching mechanism in a closed position, and with the basket rotated about its axis in the counter clockwise direction slightly from vertical such that a cam follower engages the surface of the cam plate.

When parts washer 100 is operating, gravity maintains basket 106 and lid 108 inside rotor assembly 104 so long as rotor assembly 104 is in an upright position. During the first 15° of rotor assembly 104 rotation, cam follower 118 remains within entrance opening 302. However, during the next 30° of rotation from the upright position, cam latching mechanism 109 begins to secure basket 106 and lid 108. Recall that cam plate 116 is relieved near entrance opening 302. In particular, referring to FIG. 5, within the next 30° of rotation, cam follower 118 engages cam plate 116 at cam surface 300 and progressively exerts an increasing force on basket 106 and lid 108 as the radius of cam surface 302 decreases. This force is transmitted to basket lid 108 through torsion bar 112, basket retainers 110A and 110B, and crank arm 114. The next 270° of rotor assembly 104 rotation find cam follower 118 in the base circle of cam plate 112. Thus, during the next 270° of rotor assembly 104 rotation cam follower 118 engages cam plate 116 at cam surface 502 and exerts a constant force on basket 106 and lid 108, which is transmitted through torsion bar 112, basket retainers 110A and 110B, and crank arm This force prevents basket retainers 110A and 110B from disengaging from basket 106 and lid 108.

Similarly, during the final 30° rotation before cam follower 118 reaches opening 302 cam follower 118 progressively disengages cam plate 116 at cam surface 502 and progressively releases its force on basket 106 and lid 108. During the final 15° of rotation, cam follower 118 is aligned within entrance opening 302. As discussed above, cam plate 116 is relieved (about ±30° of rotor assembly 104 rotation) near entrance opening 302 to provide a smooth transition of cam follower 118 into entrance opening 302.

Once cam follower 110 is again aligned with opening 302, basket retainers 110A and 110B can be rotated into the open position, so that basket 106 and lid 108 may be removed from rotor assembly 104. Recall that when in this position, helper spring 120 and cross center crank 122 keep cam retaining mechanism 109 from falling on the operator's hands while unloading the now cleaned parts.

IV. Construction of Parts Washer 600

Figure 6:
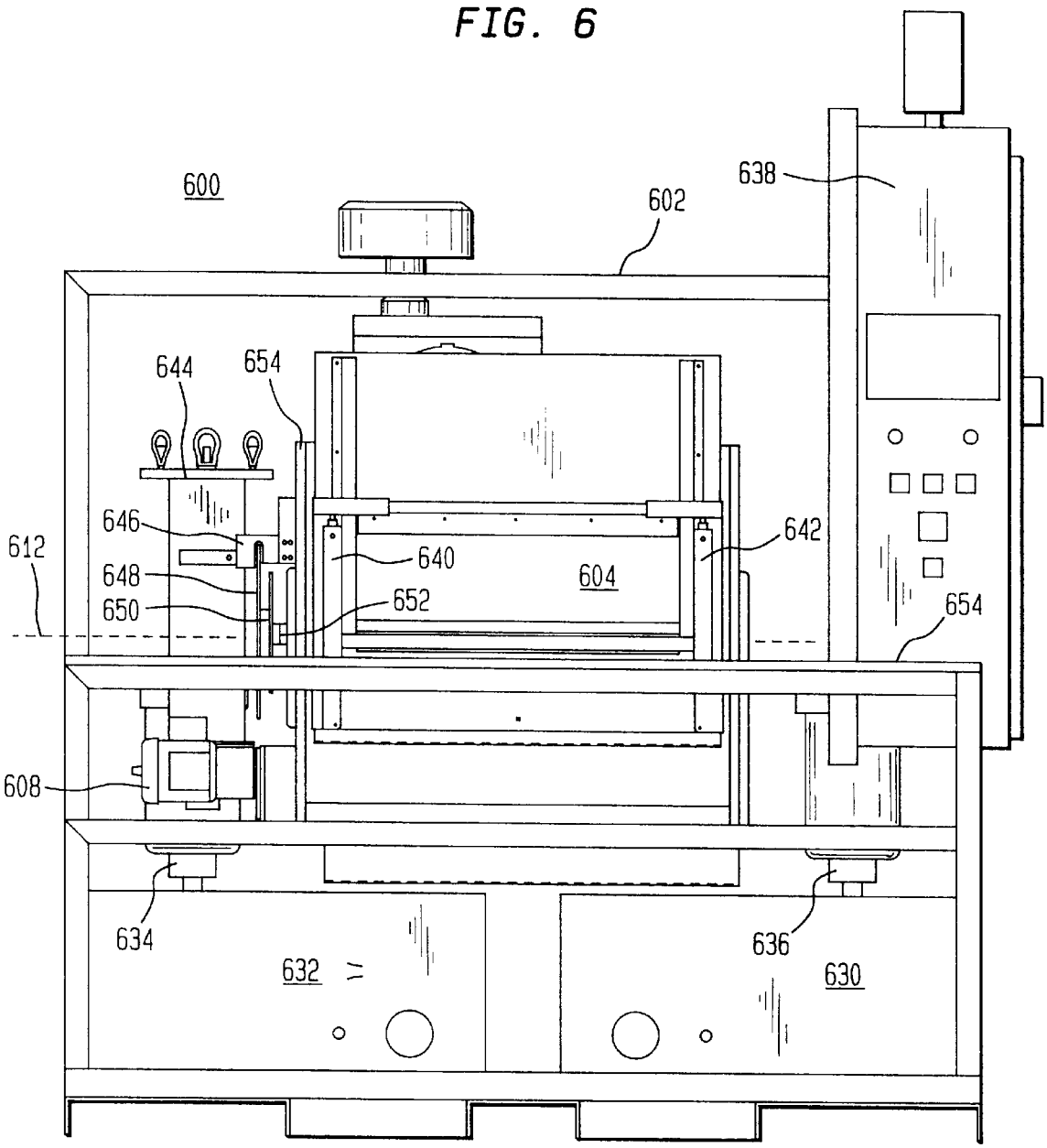
FIG. 6 is a front view of a second preferred embodiment of the invention implemented in a front-loading parts washer 600 (note that the front panels of the parts washer are removed to illustrate the interior of the washer)

FIG. 6 illustrates a second preferred embodiment of the present invention in a parts washer 600. In this embodiment, the invention is implemented in a front-loading, rotating parts washer 600 that accepts two baskets at a time. Structure and operation of the invention in this second embodiment is substantially similar to the operation of the first embodiment. However, the rotor assembly in parts washer 600 is configured to accept two baskets; each basket being mounted at opposite sides of the rotor so that they are loaded into the rotor 180° of rotation apart from one another. In addition, lids are not used with the baskets. Instead, the rotor assembly itself forms a lid for each basket as it is slid horizontally into the rotor assembly.

To accommodate two baskets, this embodiment of the invention includes two cam latching mechanisms; one for each basket. The cam latching mechanisms are actuated 180° apart from one another so that while one basket is in an unsecured, upright position for loading/unloading, the other basket is held securely in the rotor in an upside down position.

Referring now to FIG. 6, parts washer 600 is described. In this figure, the cover panels have been removed to show the internal elements. Parts washer 600 includes a housing 602 having a door 604 and a loading deck 654. Control electronics 638 are mounted on a side of housing 602. A wash water tank 632, wash pump 634, rinse water tank 630, rinse pump 636 and wash water filter 644 are mounted within housing 602 as illustrated. Motor 608 drives rotor shaft 652 for rotation about axis 612 via a sprocket 650 and chain (not shown). An actuator plate 648 is mounted on drive shaft 652. Actuator plate 648 is used to determine the rotational position of shaft 652. Actuator plate 648 is also used by rotor lock actuator 646 to lock the rotor in one of the two loading/unloading positions. To lock the rotor and prevent rotation, actuator 646 drives a pin through a hole in actuator plate 648.

Figure 10:
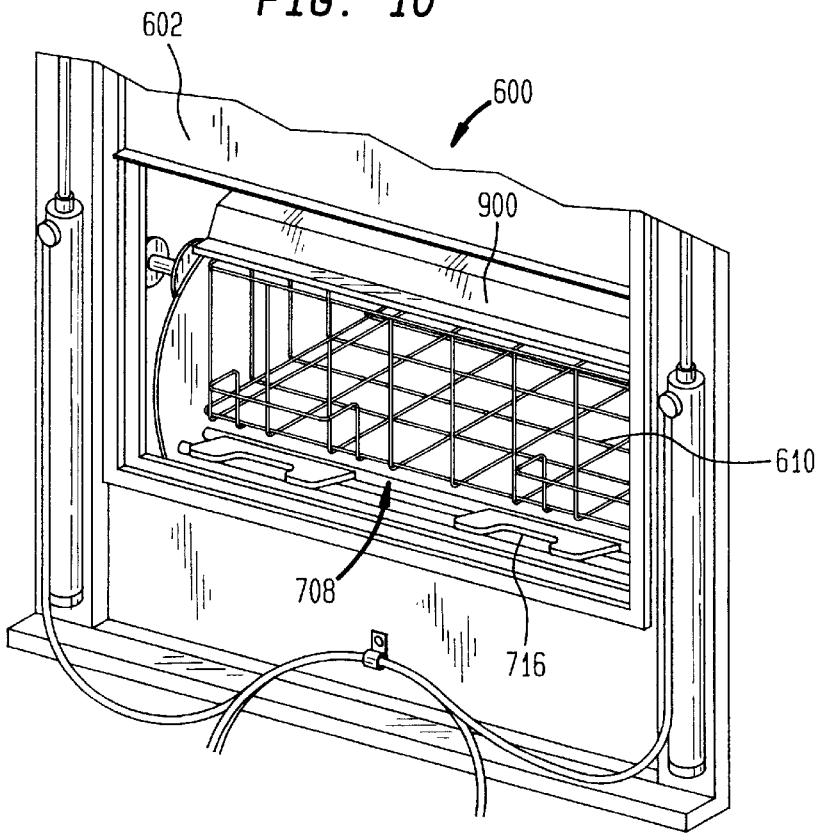
FIG. 10 shows the parts washer 600 with the door open, a basket in position in the rotor assembly, and a torsion bar assembly in the open position.
Figure 11:
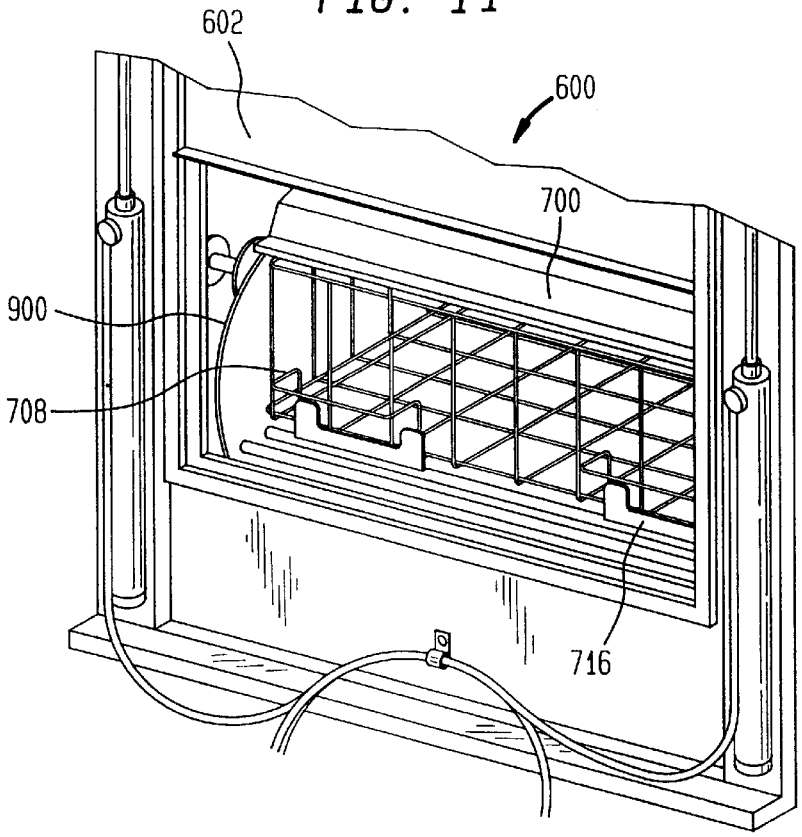
FIG. 11 shows the parts washer 600 with the door open, a basket in position in the rotor assembly, and a torsion bar assembly in the closed position.

Door 604 is shown in a closed position. Door 604 is opened by pneumatic cylinders 640,642, which slide the door up when actuated. As shown in this closed position, the rotor assembly 700, cam plate 1402 and baskets 900 are not visible. Rotor assembly 700 is shown in FIGS. 7–13, cam plate 1402 is shown in FIG. 14, and a basket 900 is shown in FIGS. 9–11.

Figure 7:
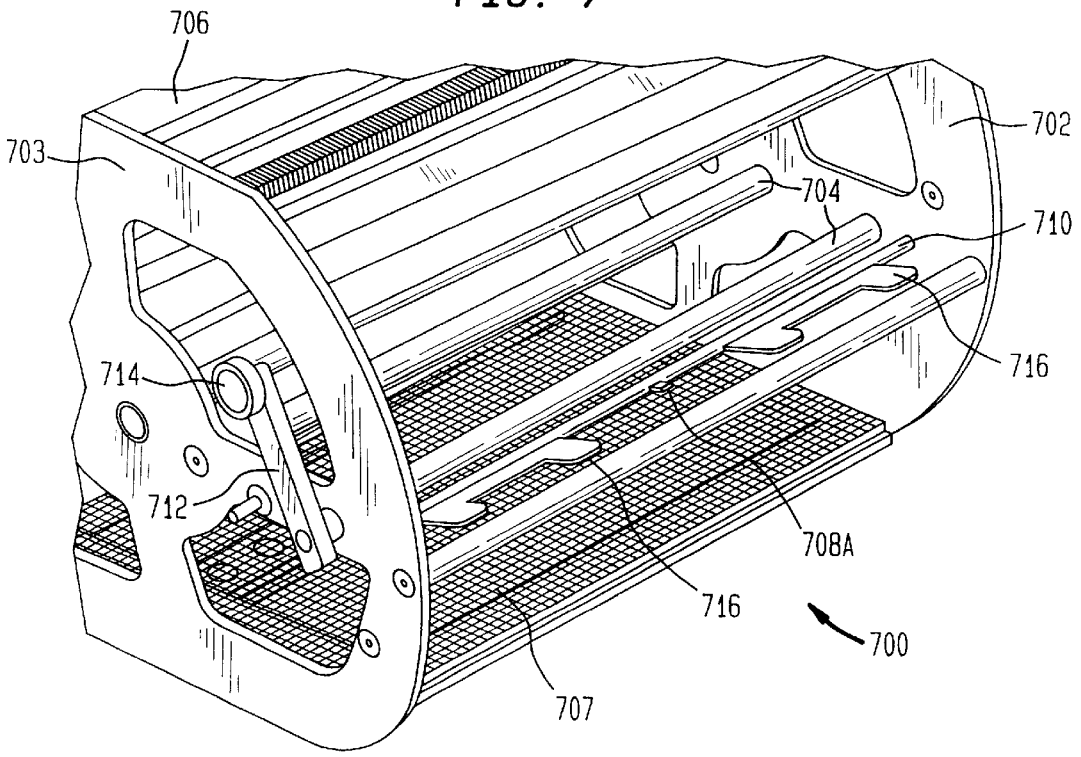
FIGS. 7 and 8 are perspective views of a rotor assembly removed from the parts washer 600 to illustrate the structure of the second embodiment of the cam latching mechanism of the invention.
Figure 8:
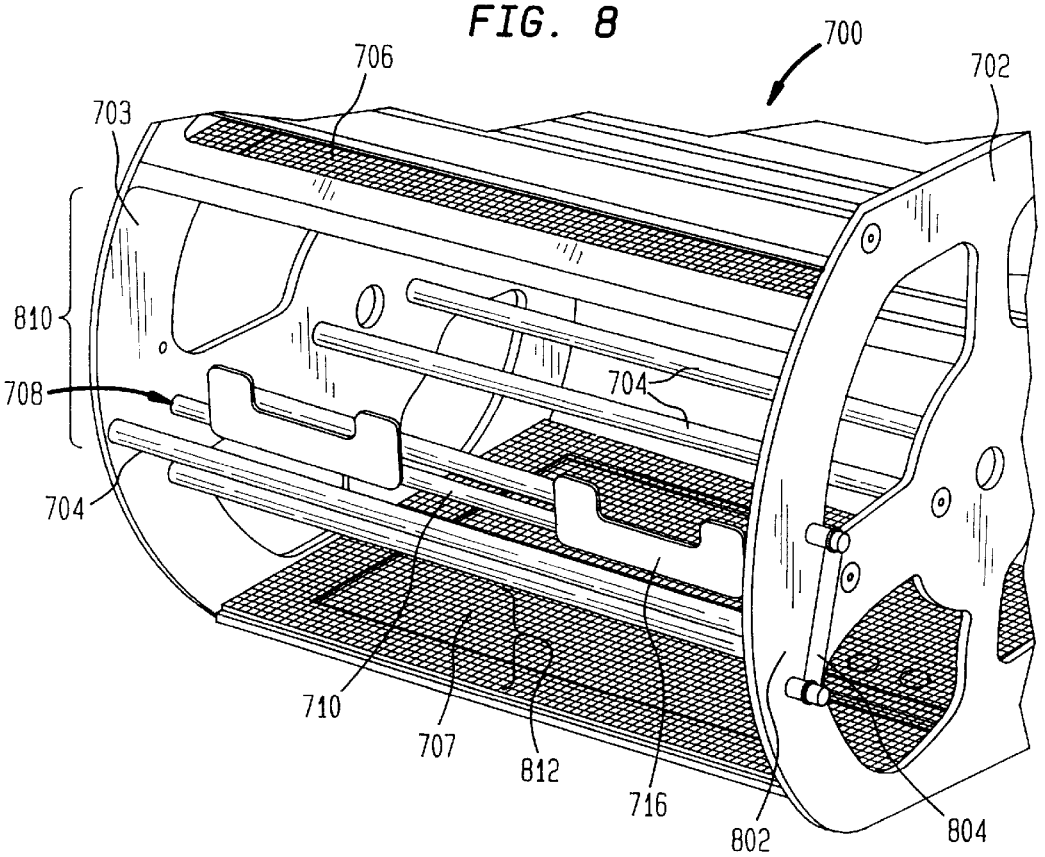

FIGS. 7 and 8 illustrate rotor assembly 700 removed from washer 600. Rotor assembly 700 includes side plates 702, 703, cross-members 704, cover plates 706,707, and torsion bar assemblies 708. Each torsion bar assembly 708 includes a torsion bar 710, a crank arm 712, a cam follower 714, basket retainers 716, a cross-center crank 802 and a helper spring 804. Note that rotor assembly 700 is symmetrical such that it includes identical torsion bar assemblies 708A, 708B. Torsion bar assembly 708B is located at an opposite side of rotor assembly 700 which is not clearly visible in FIG. 7, see FIGS. 12 and 13.)

Rotor assembly 700 forms a first basket receiving space 810 between cross-members 704 and cover plate 706 and a second basket receiving space 812 between cross-members 704 and cover plate 707. In the orientation of rotor assembly 700 shown in FIG. 8, first space 810 is configured to be loaded from the front of the figure. Torsion bar assembly 708 is positioned to hold the basket in space 810 with cover plate 706 acting as a lid for the basket. Also in this orientation, second space 812 is configured to be loaded from the rear of the figure. Torsion bar assembly 708B is positioned to hold a basket in space 812 with cover plate 707 acting as a lid for the basket.

Figure 9:
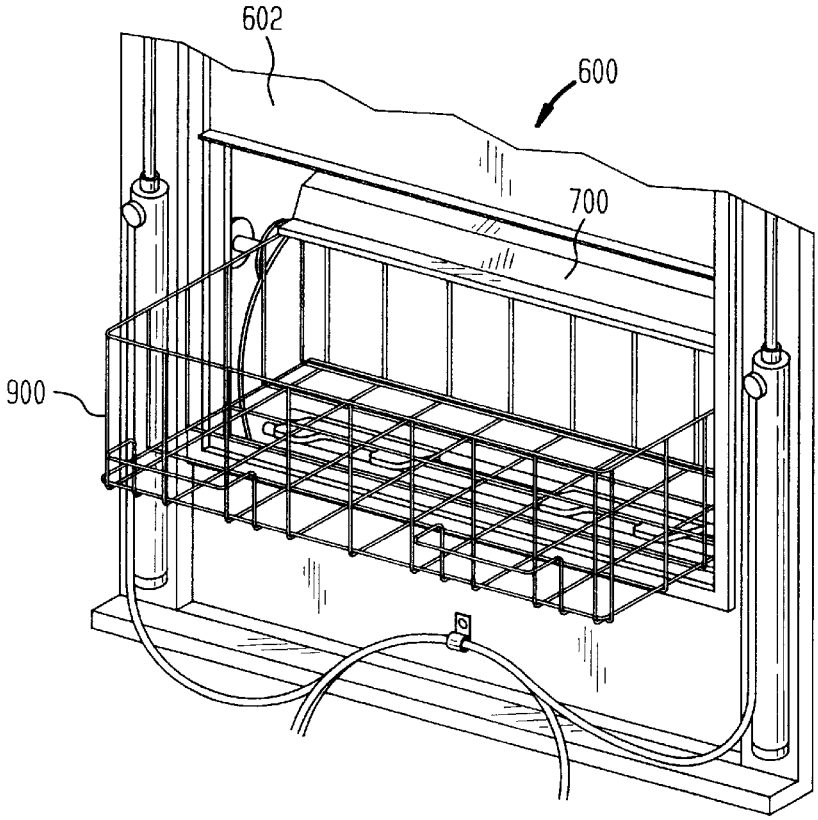
FIG. 9 shows the parts washer 600 with the door open and a basket partially removed.

FIG. 9 shows a basket 900 being slide in space 810 of rotor assembly 700. FIG. 10 shows basket 900 positioned in space 810 of rotor assembly 700. Note how torsion bar assembly 708 is rotated so that basket retainers 716 are pivoted out of the way to permit basket 900 to enter space 810. Spring 804 and crosscenter crank 802 will hold torsion bar assembly 708 in this open position until it is either manually moved to the closed position or the rotor is rotated.

FIG. 11 shows basket 900 positioned in space 810 of rotor assembly 700 with torsion bar assembly 708 rotated into the closed position. Note that the torsion bar assembly is held in this position only by the force of spring 804. Crank arm 712 will not prevent torsion bar 710 from being moved into the open position until the rotor assembly is rotated from this loading/unloading position. As described below, upon rotation of the rotor, the torsion bar is automatically forced into (and held in) the closed position to prevent basket 900 from being removed from space 810.

If rotor assembly 700 is rotated 180° from the position shown in FIGS. 9 and 10, space 812 will be positioned for loading/unloading as described for space 810.

Figure 12:
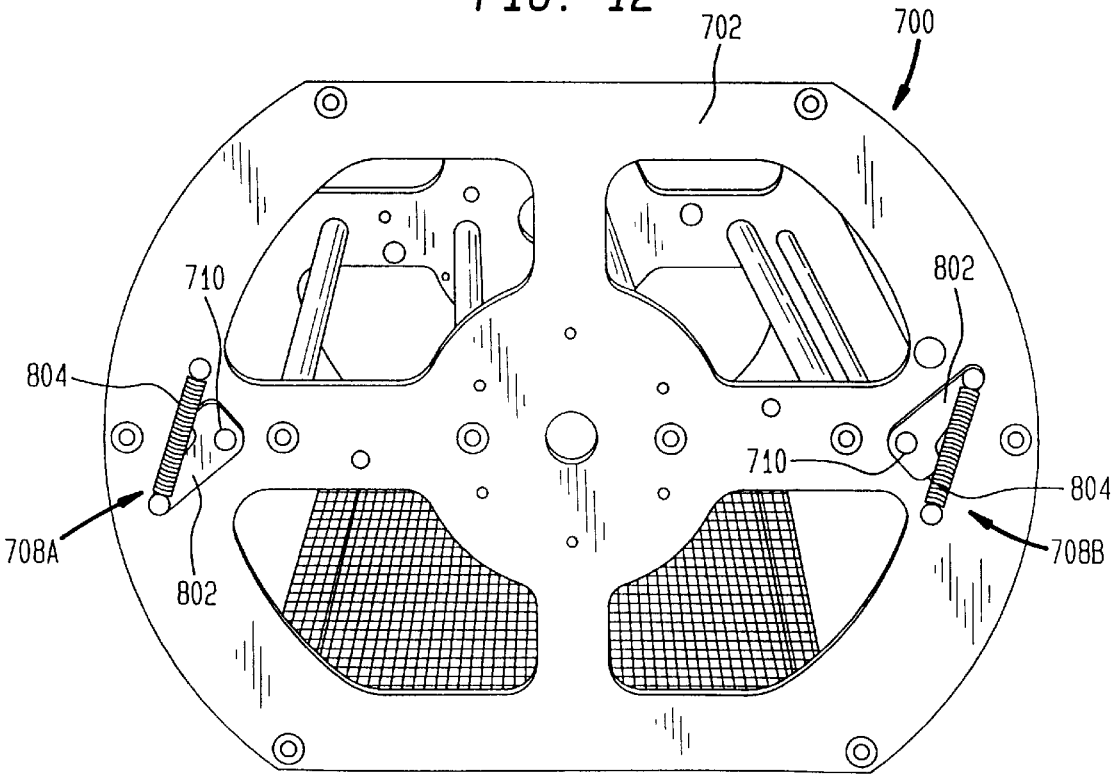
FIG. 12 is an end view of the rotor assembly illustrating the cross-center cranks and springs of the torsion bar assemblies.

FIG. 12 is an end view of rotor assembly 700 showing end plate 702. Note the identical configuration of the cross-center cranks 802 and springs 804 mounted on the ends of torsion bars 710.

Figure 13:
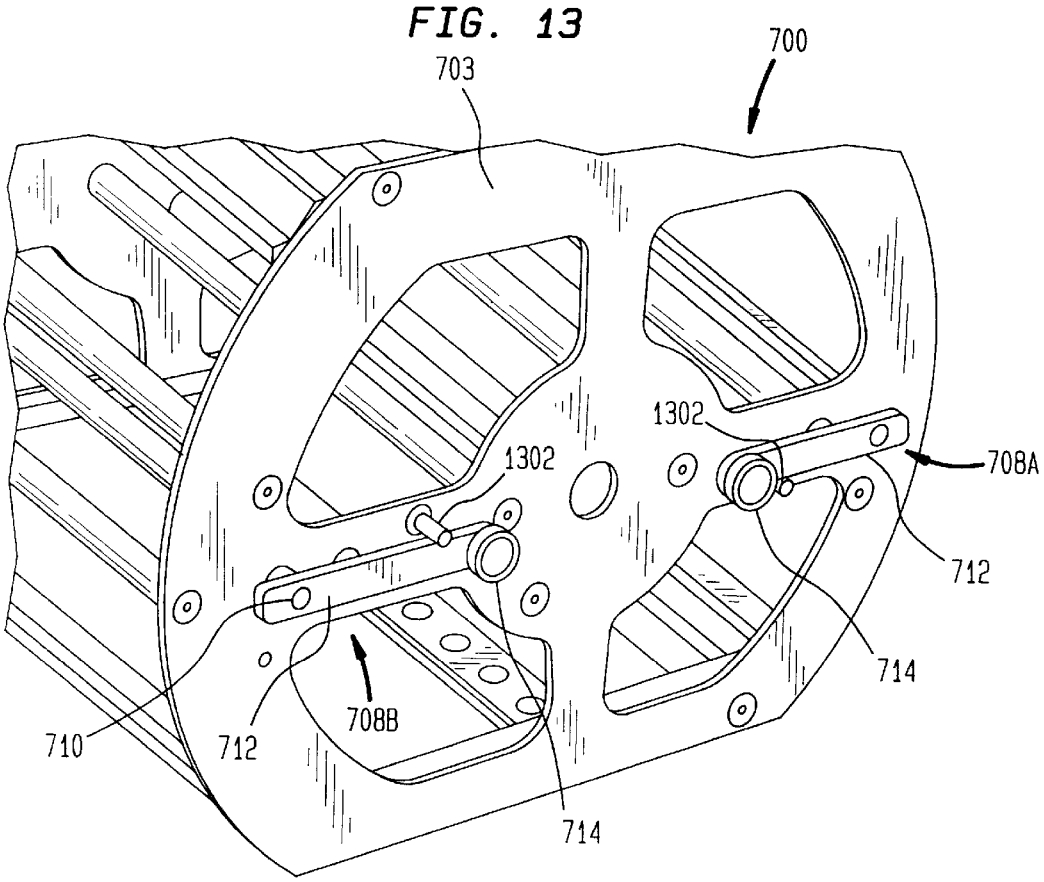
FIG. 13 is an end view of the rotor assembly illustrating the crank arms and cam followers of the torsion bar assemblies.
Figure 14:
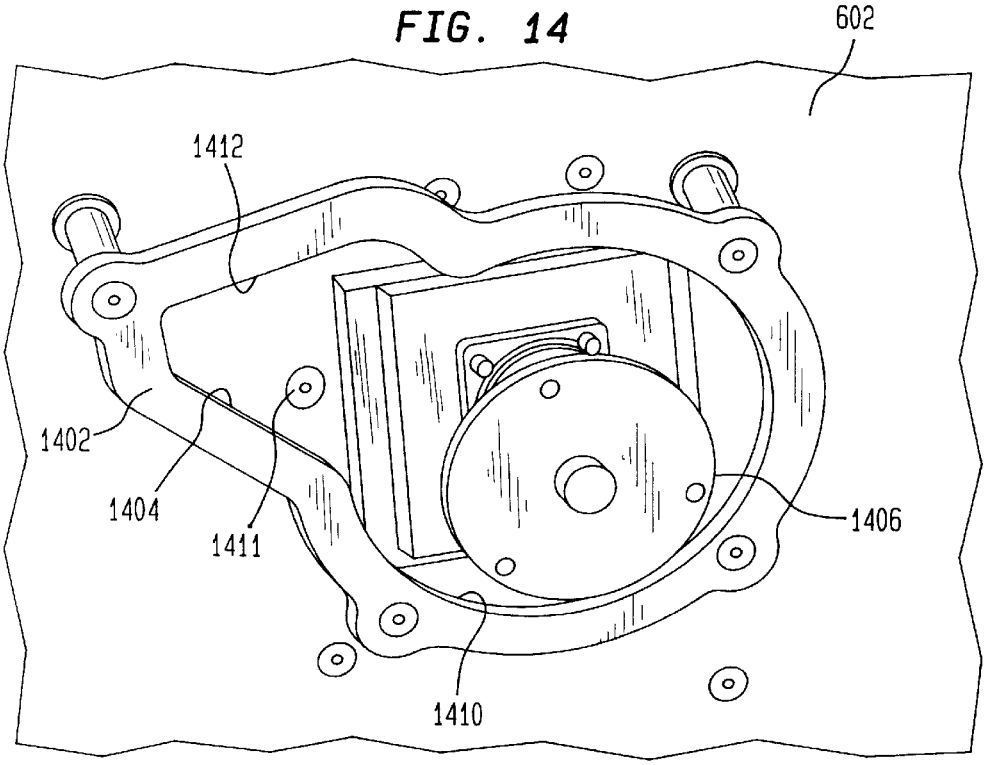
FIG. 14 shows a cam plate mounted to an interior wall of the housing of parts washer 600.

FIG. 13 is an end view of rotor assembly 700 showing end plate 703. Note the identical configuration of the crank arms 712 and cam followers 714 mounted on the ends of torsion bars 710. Also note the stop pins 1302 that prevent over rotation of torsion bars 710.

FIG. 14 is a view of the inside of housing 602 of washer 600 with rotor assembly 700 removed. A cam plate 1402 is mounted to the interior wall of housing 602. Cam plate 1402 defines a cam surface 1404 that is configured to mate with cam follower 714 of torsion bar assembly 708. A drive mechanism 1406 is configured to engage end plate 703 of rotor assembly 700 to rotate the rotor assembly during a wash operation. Drive mechanism 1406 is driven by motor 608 as described above.

Cam surface 1404 of cam plate 1402 defines a holding cam surface 1410, an open portion 1411 and a closing cam surface 1412. Holding cam surface 1410 is a substantially circular cam surface that, when engaged by cam follower 714, holds torsion bar assembly 708 in the closed position. Open portion 1411 releases cam follower 714 so that torsion bar assembly 708 may be manually moved to the open position by an operator. In response to rotation of rotor assembly 700, closing cam surface 1412 engages cam follower 714 when torsion bar assembly 708 is in the open position and will force torsion bar assembly 708 into the closed position in preparation for cam follower 714 to engage holding cam surface 1410.

V. Operation of Parts Washer 600

Figure 15:
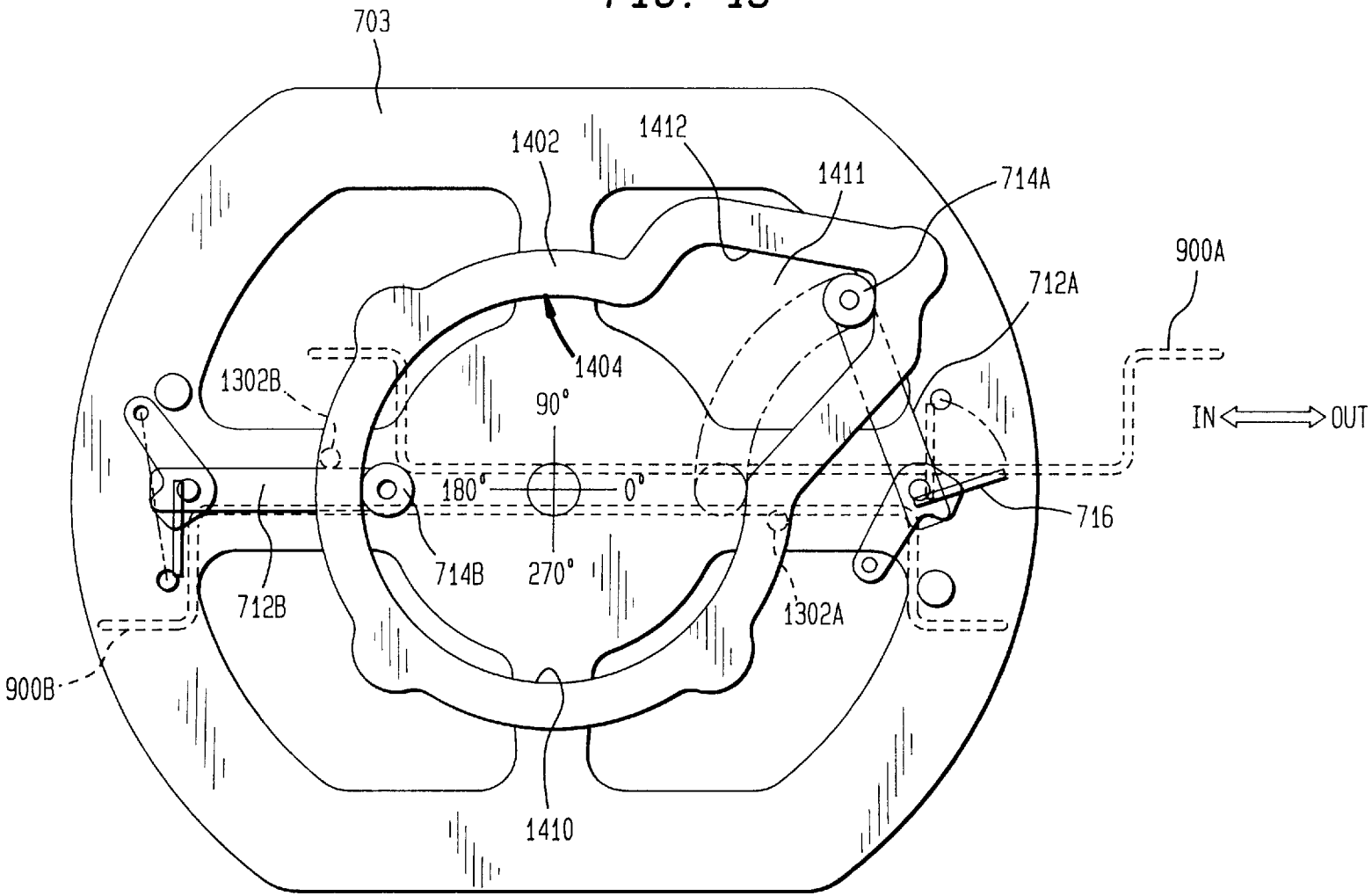
FIGS. 15–18 show an end view of the rotor assembly with the cam plate superimposed thereon to illustrate operation of the cam latching mechanism of the invention during rotation of the rotor assembly.

FIGS. 15–18 illustrate operation of the cam latching mechanism of the invention in this second embodiment of the invention. Each of these figures shows an end view of end plate 703 with cam plate 703 superimposed onto it. In FIG. 15, rotor assembly 700 is in a first load/unload position (0° of rotation). In this position, note that cam follower 714A may be moved between the open and closed positions. To move to the open position, cam follower 714A is rotated into open portion 1411 of cam surface 1404.

Cam follower 714A must be manually moved to the open position by an operator. One way to accomplish this is for the operator to grab the basket and pull it out of the rotor assembly. As the basket is pulled out of the rotor assembly, the basket will push against basket retainers 716 and force torsion bar assembly 708 into the open position. Once in the open position, cross-center crank 802 and spring 804 will maintain torsion bar assembly 708 in that position.

Note that in the rotational position of rotor assembly 700 shown in FIG. 15, cam follower 714B is engaged with holding cam surface 1410. This engagement prevents crank arm 712B from being rotated to the open position so that basket 900B cannot be removed from rotor assembly 700. Note that operation of the cam latching mechanisms is identical and occurs 180° of rotation out of phase with respect to one another. Accordingly, in the interest of brevity, operation of the invention is primarily described with reference to cam follower 714A and crank arm 712A.

Figure 16:
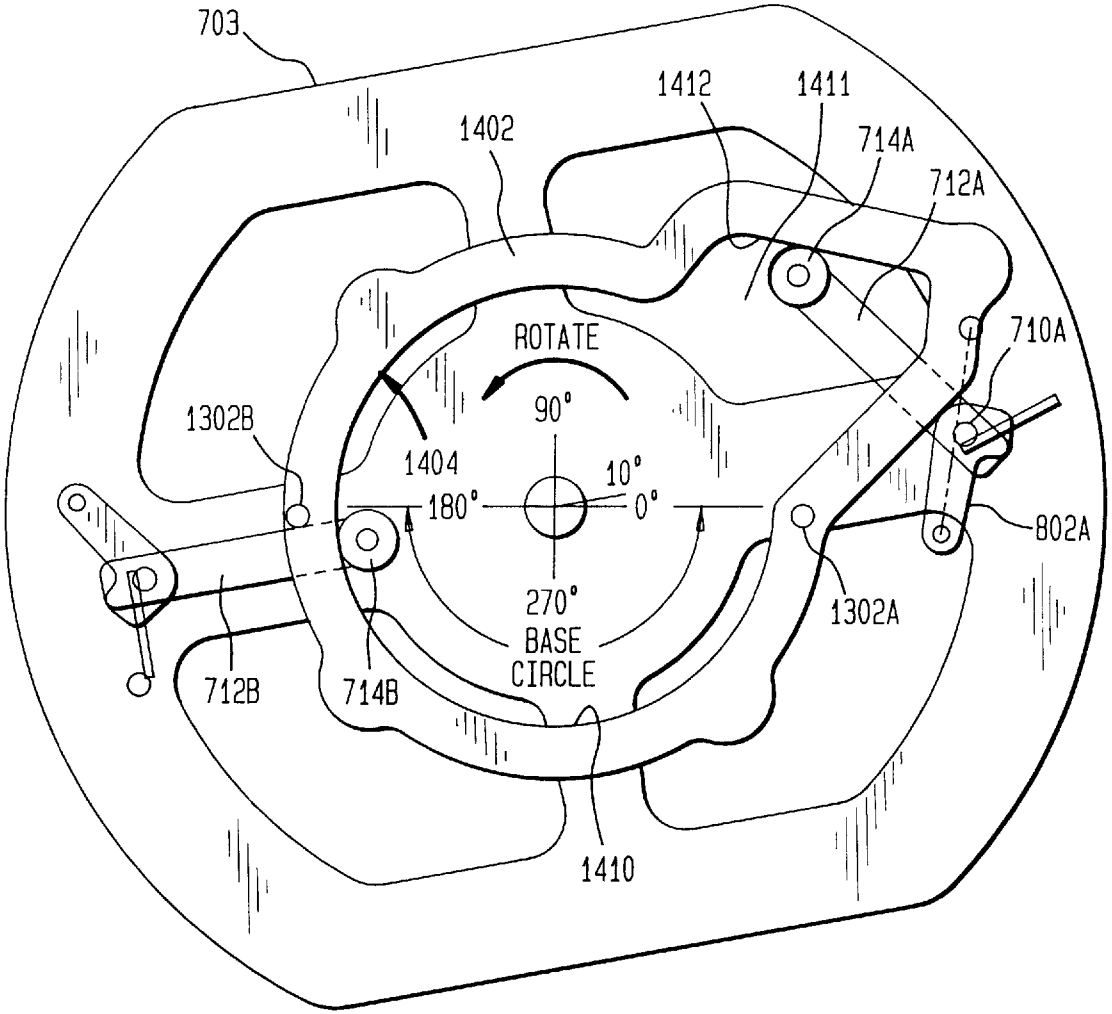

In FIG. 16, rotor assembly 700 has been rotated 10° counter-clockwise. In this position, note that closing cam surface 1412 begins to move cam follower 714A into the closed position. In the position shown in FIG. 16, crank arm 712A has been rotated to the point at which cross-center crank 802A will toggle from holding torsion bar 710A in an open position to holding torsion bar 710A into a closed position. This change in state for cross-center crank 802A will occur when its axis of rotation (torsion bar 710A) passes through a longitudinal axis of spring 804A.

Figure 17:
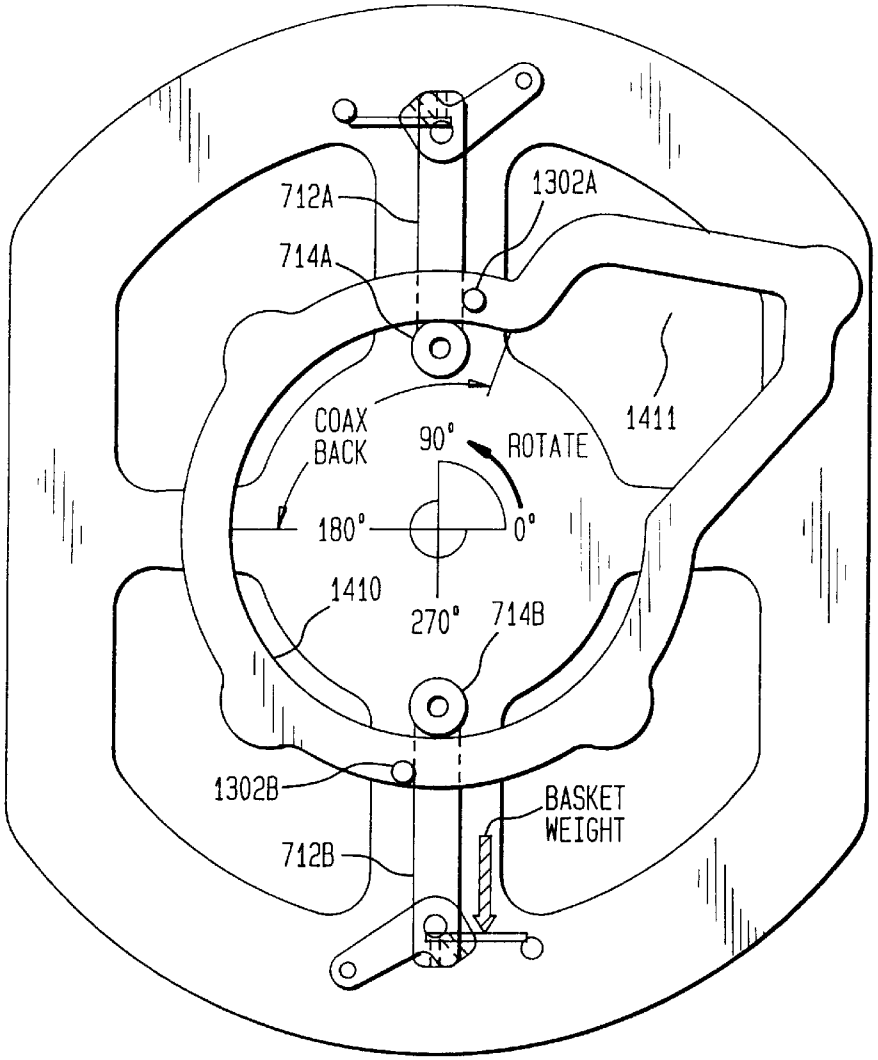

In FIG. 17, rotor assembly 700 has been rotated 90° counter-clockwise. In this position, cam follower 714A has been moved to the closed position by closing cam surface 1412. Cross-center crank 802A and spring 804A are holding crank arm 712A against stop pin 1302A. Note that cam follower 714A is not yet in close coupling with holding cam surface 1410. This is done to provide a smooth engagement of cam follower 714A with cam surface 1404. Note also that cam follower 714B continues to maintain contact with holding cam surface 1410 to hold basket 900B securely in rotor assembly 700.

Figure 18:
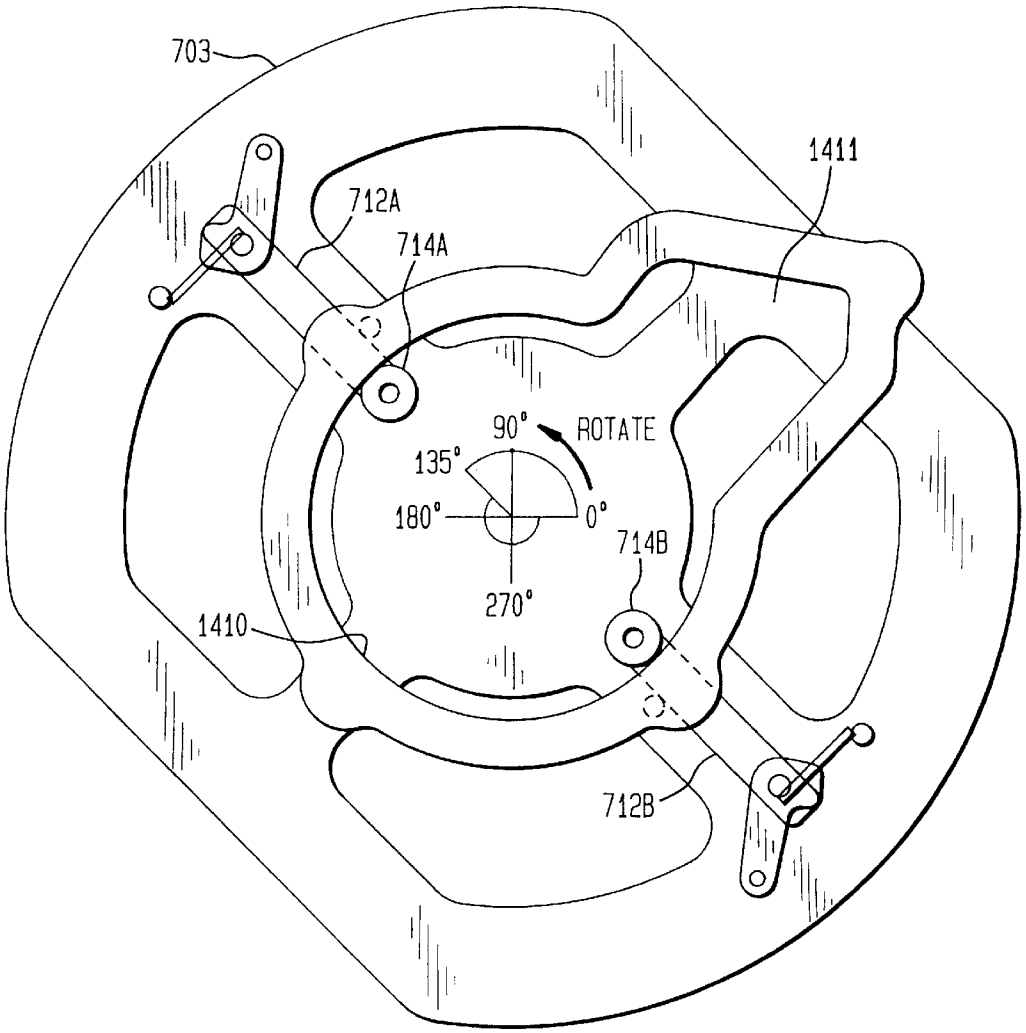

In FIG. 18, rotor assembly 700 has been rotated 135° counter-clockwise. In this position, cam follower 714A is moving into closer contact with holding cam surface 1410. Note that basket 900A is held in the rotor assembly by gravity between 0° and 180° of rotation. It is not until the rotor has passed 180° of rotation that gravity will try to pull basket 900A out of the rotor assembly. Thus, by 180° of rotation cam follower 714A is in positive contact with holding cam surface 1410 so that basket retainers 716 will hold basket 900A securely in rotor assembly 700. This is illustrated in FIG. 15 for cam follower 714B. This positive contact is maintained between approximately 180° and 360° of rotation for cam follower 714A and between approximately 0° and 180° of rotation for cam follower 714B.

While the invention has been particularly shown and described with reference to preferred embodiments thereof, it will be understood by those skilled in the art that various changes in form and details may be made therein without departing from the spirit and the scope of the invention.

What is claimed is:

1. A tumbling-type parts washer comprising:

a housing;

a rotor assembly disposed within said housing, said rotor assembly being configured to receive for tumbling a basket for holding parts to be cleaned;

a cam plate mounted on an inner wall of said housing adjacent said rotor assembly and having an inner diameter that defines a substantially circular cam surface, said inner diameter accessible through an open portion in said cam plate; and a torsion bar assembly mounted on said rotor assembly for rotation therewith, wherein cooperation between said torsion bar assembly and said inner diameter cam surface of said cam plate secures the parts in the basket during at least a portion of rotation of said rotor assembly from a loading/unloading position.

2. The parts washer of claim 1, wherein said rotor assembly is configured to receive a plurality of baskets.

3. The parts washer of claim 1, wherein the basket is removable from said rotor assembly.

4. The parts washer of claim 1, wherein the basket is fixedly mounted in said rotor assembly.

5. A tumbling-type parts washer comprising:

a housing;

a rotor assembly disposed within said housing, said rotor assembly being configured to receive for tumbling a basket for holding parts to be cleaned; and cam latching means for automatically securing the basket in said rotor assembly during at least a portion of rotation of said rotor assembly from a loading/unloading position, said cam latching means including:

a cam plate mounted on an inner wall of said housing adjacent said rotor assembly; and a torsion bar assembly mounted on said rotor assembly for rotation therewith, said torsion bar assembly being operable between an open position that permits removal of the basket from the rotor assembly and a closed position that prevents removal of the basket from said rotor assembly, wherein cooperation between said torsion bar assembly and said cam plate prevents said torsion bar assembly from being moved to the open position during at least a portion of rotation of said rotor assembly from the loading/unloading position.

6. The parts washer of claim 5, wherein said cam plate defines a substantially circular cam surface with an open portion, and wherein said torsion bar assembly comprises:

a torsion bar pivotally mounted on said rotor assembly, said torsion bar being operable between the open position and the closed position;

basket retaining means, mounted on said torsion bar, for permitting the basket to be removed from said rotor assembly when said torsion bar is in the open position, and for preventing removal of the basket when said torsion bar is in the closed position; and a cam follower mounted on a crank arm portion of said torsion bar, said cam follower being configured to align with the open portion of the cam surface when the rotor assembly of the parts washer is in the loading/unloading position to permit said torsion bar to be pivoted between the open position and the closed position for removal of the basket, and to engage the cam surface of said cam plate during at least a portion of rotation of said rotor assembly when said torsion bar is in the closed position and the rotor assembly is rotated from the loading/unloading position, said engagement preventing said torsion bar from being moved to the open position.

7. The parts washer of claim 6, wherein a radius of the substantially circular portion of said cam surface is relieved near the open portion to provide smooth engagement/disengagement of said cam follower with said cam surface during rotation of said rotor assembly.

8. The parts washer of claim 6, wherein said torsion bar assembly further comprises:

means for urging said basket retaining means away from the basket when said torsion bar is in the open position and for urging said basket retaining means toward the basket when said basket retaining means is in the closed position.

9. The parts washer of claim 8, wherein said urging means comprises:

a helper spring; and a cross-center crank.

10. The parts washer of claim 9, wherein said basket retaining means comprises:

at least one U-shaped basket retainer mounted on said torsion bar.

11. The parts washer of claim 6, wherein said housing is a top-loading housing having a door and wherein a portion of said torsion bar assembly rests against the door when the door is open and when said torsion bar assembly is in the open position such that closing said door will force said torsion bar assembly into the closed position, thereby assuring that said torsion bar assembly is in the closed position during operation of the parts washer.

12. The parts washer of claim 6, wherein said housing is a top-loading housing and said rotor assembly is configured to receive a single basket and lid, operation of said cam latching mechanism securing said lid to the basket and securing the basket in said rotor assembly upon rotation of said rotor assembly from a vertical loading/unloading position.

13. The parts washer of claim 6, wherein said housing is a front-loading housing having a door and wherein said rotor assembly is configured to receive two baskets having loading/unloading positions that are positioned 180° of rotation apart.

14. A tumbling-type part washer comprising:

a housing;

a rotor assembly disposed within said housing, said rotor assembly being configured to receive for tumbling a plurality of baskets for holding parts to be cleaned; and cam latching means for automatically securing the basket of baskets in said rotor assembly during at least a portion of rotation of said rotor assembly from a loading/unloading position, wherein said cam latching means comprises:

a cam plate mounted on an inner wall of said housing adjacent said rotor assembly; and a torsion bar assembly for each basket received by said rotor assembly, each torsion bar assembly being mounted on said rotor assembly for rotation therewith, each torsion bar assembly being operable between an open position that permits removal of a corresponding basket from the rotor assembly and a closed position that prevents removal of the corresponding basket from said rotor assembly, wherein cooperation between each torsion bar assembly and said cam plate prevents each torsion bar assembly from being moved to the open position during at least a portion of rotation of said rotor assembly from the loading/unloading position for the corresponding basket.

15. The parts washer of claim 14, wherein said cam plate defines a substantially circular cam surface with an open portion, and wherein each torsion bar assembly comprises:

a torsion bar pivotally mounted on said rotor assembly, said torsion bar being operable between the open position and the closed position;

basket retaining means, mounted on said torsion bar, for permitting the corresponding basket to be removed from said rotor assembly when said torsion bar is in the open position, and for preventing removal of the corresponding basket when said torsion bar is in the closed position; and a cam follower mounted on a crank arm portion of said torsion bar, said cam follower being configured to align with the open portion of the cam surface when the rotor assembly of the parts washer is in the loading/unloading position to permit said torsion bar to be pivoted between the open position and the closed position for removal of the corresponding basket, and to engage the cam surface of said cam plate during at least a portion of rotation of said rotor assembly when said torsion bar is in the closed position and the rotor assembly is rotated from the loading/unloading position, said engagement preventing said torsion bar from being moved to the open position.

16. The parts washer of claim 15, wherein a radius of the substantially circular portion of said cam surface is relieved near the open portion to provide smooth engagement/disengagement of each cam follower with said cam surface during rotation of said rotor assembly.

17. The parts washer of claim 15, wherein each torsion bar assembly further comprises:

means for urging said basket retaining means away from the corresponding basket when said torsion bar is in the open position and for urging said basket retaining means toward the corresponding basket when said basket retaining means is in the closed position.

18. The parts washer of claim 17, wherein said urging means comprises:

a helper spring; and a cross-center crank.

19. An apparatus for automatically securing a removable basket in a rotor assembly of a tumbling-type parts washer comprising:

cam path means for defining a cam path;

a removable basket for holding parts to be washed; and cam follower means, mounted for rotation with the rotor assembly, for cooperating with said cam path means to automatically secure said removable basket in the rotor assembly during at least a portion of rotation of said rotor assembly from a loading/unloading position.

20. The apparatus of claim 19, wherein said cam path means comprises:

a cam plate configured for mounting to a housing of the parts washer, said cam plate defining a substantially circular cam surface with an open portion.

21. An apparatus for automatically securing a basket in a rotor assemble of a tumbling-type parts washer comprising:

cam path means for defining a cam path and including a cam plate configured for mounting to a housing of the parts washer, said cam plate defining a substantially circular cam surface with an open portion; and cam follower means, mounted for rotation with the rotor assembly, for cooperating with said cam path means to automatically secure the basket in the rotor assembly during at least a portion of rotation of said rotor assembly from a loading/unloading position, wherein said cam follower means comprises:

a torsion bar pivotally mounted on said rotor assembly, said torsion bar being operable between an open position and a closed position;

basket retaining means, mounted on said torsion bar, for permitting the basket to be removed from the rotor assembly when said torsion bar is in the open position, and for preventing removal of the basket when said torsion bar is in the closed position; and a cam follower mounted on a crank arm portion of said torsion bar, said cam follower being configured to align with the open portion of the cam surface when the rotor assembly of the parts washer is in the loading/unloading position to permit said torsion bar to be pivoted between the open position and the closed position for removal of the basket, and to engage the cam surface of said cam plate during at least a portion of rotation of said rotor assembly when said torsion bar is in the closed position and the rotor assembly is rotated from the loading/unloading position, said engagement preventing said torsion bar from being moved to the open position.

22. The apparatus of claim 21, wherein a radius of the substantially circular cam surface of said cam plate is relieved near the open portion to provide smooth engagement/disengagement of said cam follower with said cam surface during rotation of said rotor assembly.

23. The apparatus of claim 21, wherein said torsion bar assembly further comprises:

means for urging said basket retaining means away from the basket when said torsion bar is in the open position and for urging said basket retaining means toward the basket when said basket retaining means is in the closed position.

24. A tumbling-type parts washer comprising:

a housing;

a removable basket for holding parts to be cleaned;

a rotor assembly disposed within said housing, said rotor assembly being configured to receive said removable basket; and cam latching means for automatically securing said removable basket in said rotor assembly during at least a portion of rotation of said rotor assembly from a loading/unloading position.

* * * * *